United States Patent [19]

Edinger et al.

[11] 3,990,389

[45] Nov. 9, 1976

[54] COATING APPARATUS

[75] Inventors: Egon Edinger, Graefelfing; Franz Bauer, Pullach, both of Germany

[73] Assignee: Siemens Aktiengesellschaft, Berlin & Munich, Germany

[22] Filed: July 30, 1975

[21] Appl. No.: 600,290

[30] Foreign Application Priority Data

Aug. 19, 1974 Germany ..... 2439677

[52] U.S. Cl. ..... 118/76; 51/5 R

[51] Int. Cl.[2] ..... B05C 11/00

[58] Field of Search ..... 118/76, 77, 78; 427/11; 51/5 R

[56] References Cited

UNITED STATES PATENTS

| | | | |
|---|---|---|---|
| 2,424,261 | 7/1947 | Toulmin, Jr. | 118/76 X |
| 2,914,425 | 11/1959 | McGuire | 427/11 |
| 3,793,779 | 2/1974 | Perralla | 51/5 R |

*Primary Examiner*—Morris Kaplan

*Attorney, Agent, or Firm*—Hill, Gross, Simpson, Van Santen, Steadman, Chiara & Simpson

[57] ABSTRACT

A method of applying ignition lines to the interior surface of glass walled surge voltage arrestors and an apparatus for the application thereof. The surge lines are applied by first roughing the interior surface at least in the area in which the ignition line is to be applied, and thereafter applying a graphite ignition line by rubbing a graphite pencil on the roughened surface.

2 Claims, 5 Drawing Figures

COATING APPARATUS

BACKGROUND OF THE INVENTION

1. Field of the Invention

This invention relates to surge voltage arrestors with graphite ignition lines therein, and more particularly to an apparatus for applying the ignition lines.

2. Prior Art

In the construction and operation of open ar transmission lines and cables, particularly in association with communication installations, provision must be made to deal with external surge voltages. Additionally, internal surge voltages can also arise, for example as a result of intentional or unintentional switching operations occurring in installations and devices associated with the apparatus. In order to avoid damages which can result from such surges, and in order to further minimize the danger to individuals working around such equipment it is necessary to provide means to limit the surge voltages to harmless values. For this purpose, it has been known to use surge voltage arrestors having electrodes located in an inert gas atmosphere. Such voltage arrestors generally consist of hollow cylindrical glass members filled with inert gas, the glass cylinders having an opposed axial ends sealed gas tight by caps which form spaced apart electrodes. In order to provide for stable ignitions at preselected minimum threshold voltages, devices identified as ignition lines are provided in the hollow cylindrical glass members.

The ignition lines which function in the manner of an internal electrode, are formed by means of elongated relatively narrowed dashlike electrically conductive coatings on the interior wall of the glass member. The length of the ignition line is maintained less than the glass member so that predetermined clearance distances are maintained between the ignition line, or lines and the respective end electrodes.

The insertion of the ignition line into the hollow cylindrical glass member has, heretofore, been carried out manually by the application of a suspension of colloid graphite in water, the application being by means of brush. Such prior techniques have not been automatable and quality control is difficult. One identifiable problem is the fact that the solid ingredients of the graphite suspension settle out of the suspension and thus the amount of colloid graphite which will deposit at any given time by the brush technique is not predeterminable.

It would therefore be an improvement in the art of manufacture of surge voltages arrestors to provide an apparatus for the insertion of ignition lines in the hollow cylindrical glass members of such arrestors which method is easily automatable and which will provide for the application of a sufficiently precise predetermined amount of electrically conductive coating by the automated equipment.

SUMMARY OF THE INVENTION

Our invention overcomes the disadvantages of the prior art and the apparatus thereof provides an automatable method of applying ignition lines to the interior glass surface of surge voltage arrestors in a quality controllable manner. The method first roughens the surface of the glass member, at least in the area of desired adhesion of the ignition line, and thereafter applies the electrically conductive coating, preferably a solid graphite mixture, by the use of a graphite pencil.

The graphite pencil leaves, for all practical purposes, almost no trace on non-roughened glass surfaces. However, surprising, it has been determined that predetermined selected amounts of graphite can be applied onto roughened glass surfaces with a graphite pencil with the amounts being applied exhibiting a good adhesion to the glass surface. A graphite pencil consisting of hardened mixtures of graphite and a base material is utilized. Thus, for example, conventional lead pencils, which, as a rule, consist of a burned mixture of purified graphite and iron oxide-free fatty clay, are suitable for applying the ignition lines according to the teachings of this invention. The electrical resistence of the ignition line can be varied and adapted to the respective requirements of the surge voltage arrestor by varying the graphite amount applied. This can be obtained by choice of the pencil composition, i.e., control of the hardness of the graphite pencil, and by means of control of the contact pressure between the pencil and the roughened glass surface during the rubbing on of the ignition line. Due to the simple operational method herein disclosed, the invention can be easily automated and incorporated into a process of quantity production of quality controlled surge voltage arrestors.

In one preferred embodiment, a rotating grinding point is used for roughing up the area of adhesion. In other embodiments, the ignition line can be roughed by the application of a fine corundum jet. For such a purpose, a corundum powder with a range of grain sizes from 20 to 50 $\mu$m can, for example, be used.

Further, the interior walls of the glass members can be effectively roughened up over the entire surface by chemical means. In this later type of roughening it is possible to slightly etch a long glass tube throughout its entire inside length, for example, by means of the action of hydro-fluoric acid, and then to cut the glass tube to length for the individual glass members.

Preferably, the graphite pencil is subjected to both a rotational and a translational motion during the step of rubbing on of the graphite mixture. This makes possible an improved control of the quantity of graphite being applied.

We also illustrate a device for carrying out the invention in a semi-automated state which is easily fully automated if desired. In the preferred embodiment illustrated, a sliding carriage is utilized with two glass tube supporting fixtures thereon. A first movable feed slide member with adjustable stroke is provided which has a first rotating device with a first chuck mounted thereon, the chuck adapted to hold a grinding point. A second movable feed slide with an adjustable stroke is provided with a second rotating drive with a second chuck for holding a graphite pencil. The first and second feed slides are arranged on opposite sides of the sliding carriage so as to alternately insert the grinding point and the graphite pencils into the interior of the carriage carried glass tubes.

By means of such a device, the ignition lines can be semiautomatically applied. The working strokes of the two slides occur in alternating sequence so that, first, the grinding point and second, the graphite pencil are inserted into the glass tube positioned on the sliding carriage. In such a construction, only the insertion of the glass tube members onto the sliding carriage and the removal of the glass tube members therefrom are carried out by hand. Such process can, however, easily be automated by employing, for example, component insertion and removal devices such as for, example, a movable tube carrying conveyor in place of the sliding carriage.

It is another object of this invention to provide a device for applying ignition lines in surge voltage arrestors.

It is another and more particular object of this invention to provide a device for practicing the simplified method of applying graphite ignition lines to the inside surface of glass surge voltage arrestors which includes the steps of roughing the surface of the glass and thereafter applying a graphite coating by means of a graphite pencil.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTIONS OF THE DRAWINGS

DESCRIPTION OF THE PREFERRED METHOD AND EMBODIMENTS

Figure 1:
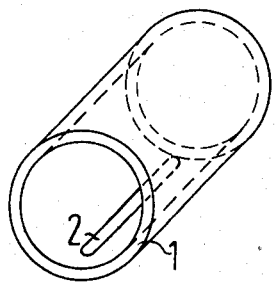
FIG. 1 is a perspective view of a glass tube suitable for use in surge voltage arrestors with a roughened area for application of an ignition line.

FIG. 1 illustrates a hollow cylindrical member 1 such as is used in the production of surge voltage arrestors. The glass member has an inner diameter surface which has an area 2, thereof roughened for application of an ignition line. The roughened area 2 provides an adhesion base that is located on the interior wall of the glass member aligned parallel to the axis thereof. The roughening of the adhesion area 2 can take place, by means of a high speed rotating grinding point. Preferably a maximum of 5 $\mu$m is removed from the surface of the glass member 1.

Figure 2:
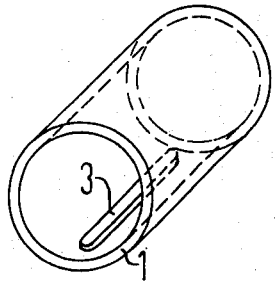
FIG. 2 is a view similar to FIG. 1 illustrating the glass member after application of an ignition line.

FIG. 2 illustrates the glass member 1 depicted in FIG. 1 at a point subsequent in time after the application of an ignition line 3 onto the adhesion area 2. The ignition line 3, which on the whole, consists of graphite, is rubbed on with a soft pencil lead. The pencil lead preferably undergoes a movement axially of the glass member in the direction of the ignition line 3 illustrated while simultaneously having a rotating motion imparted thereto. The amount of graphite rubbed on the adhesion area 2 controls the resistence of the ignition line. This amount is determined by selection of the degree of hardness of the pencil lead and by selection of the pressure force by which the pencil lead is applied to the adhesion area.

Figure 3:
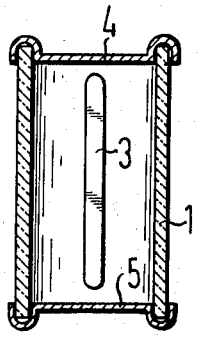
FIG. 3 is a cross-sectional view of a surge voltage arrestor equipped with an ignition line.

FIG. 3 illustrates a completed surge voltage arrestor. The glass member 1 is capped at both axial ends by lid shaped electrodes 4 and 5. The electrodes 4 and 5 are flanged and are applied to the glass body 1 in a manner which insures a gas tight seal with the glass. The glass member 1 is preferably filled with an inert gas, such as argon. The resultant surge voltage arrestor can be placed in conductive mountings, or can be provided with connective conducting wires for installation in various equipment and devices.

Figure 4:
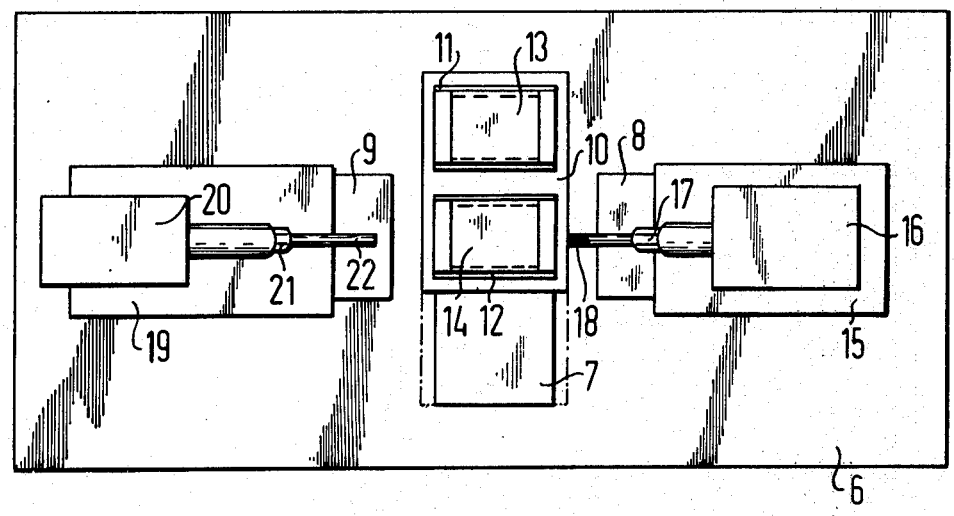
FIG. 4 is a simplified top plan view of a device for the application of ignition lines in surge voltage arrestors.
Figure 5:
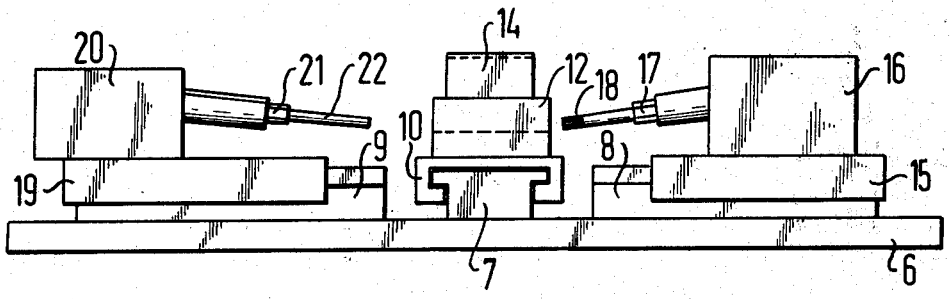
FIG. 5 is a side plan view of the device of FIG. 4.

FIGS. 4 and 5 illustrate a device for the application of the ignition line 3.

Slide bases 7, 8, and 9 are arranged on a stationary base plate 6. The slide base 7 functions as a guide for a sliding carriage 10 on which glass member supporting devices 11 and 12 are secured. Glass members 13 and 14 are respectively illustrated as being received in the glass member supporting devices 11 and 12 with the glass member supporting device 12 and the glass member 14 being illustrated in FIG. 4 in an operating position for the application of the ignition line interiorly of the glass member 14.

As illustrated in the drawing, to the right of the operating position, a feed slide 15 is guided on the slide base 8. A rotating drive 16 is carried by the feed slide 15. The rotating drive 16 is equipped with a chuck 17 which is inclined downwardly. The chuck 17 carries a diamond point 18 in a flexible manner. The inclination and the flexible spring action of the chuck 17 are selected so that movement of the feed slide 15 will cause contact between the diamond point 18 and the inner surface of the glass tube 14 at a desired point and with a desired pressure. In such a manner, sliding of the slide 15 towards the left as illustrated in FIGS. 4 and 5 will result in the roughening up of an axially extending zone of the glass member 14 by the diamond grinding point 18 thereby producing the adhesion area to of FIG. 1.

On the opposite side of the sliding carriage 10 from the feed slide 15 the feed slide 19 is provided. The feed slide 19 is guided on slide base 9 and has a second rotating drive 20 secured thereto the rotating drive 20 is equipped with a rotatable chuck 21 which is inclined downwardly and which carries a graphite pencil 22 in a flexible manner.

As is the case with the chuck 17, the inclination and the flexible spring action of the chuck 21 are so selected that, in a movement of the feed slide 19 to the right as illustrated in FIGS. 4 and 5, the ignition line 3 will be applied by the graphite pencil 22. By control of the inclination and the spring action of the chuck it will be assured that an appropriate correct amount of graphite material will be applied to the previously roughened adhesion zone 2.

The driving mechanisms for the controlled motion of the sliding carriage 10 and the feed slides 15 and 19, although not illustrated in the drawing, can be fully automated. For this purpose, for example, electric servomotors or pneumatically activated cylinders or the like can be employed.

In an automated assembly, the stroke of the feed slides 15 and 19 alternate with one another, so that initially, the adhesion area 2 of the glass member 14 is roughened up by insertion of the diamond point 18 into the glass tube 14. Thereafter the diamond point is removed and the graphite pencil 22 is inserted into the glass member 14 while rotating to apply the ignition line 3 to the just formed adhesion area 2. Finally, the alternating sliding carriage 10 is moved from the solid line position of FIG. 4 to the broken line position of FIG. 4 allowing removal of the glass member 14 with a finished ignition line therein while at the same time moving the glass member 13 into position for application of an ignition line. While the glass member 13 is being furnished with an ignition line, a new glass member can be inserted in the supporting device 12.

It can therefore be seen from the above that our invention provides both a method and apparatus for the simplified application of ignition lines to surge voltage arrestors. The method comprises the steps of first providing a glass walled tube having a smooth interior surface, second roughening up an axial length of the interior surface to provide an adhesion area, third rubbing a graphite pencil on the adhesion surface to apply a graphite ignition line while controlling the hardness of the graphite pencil and the pressure of the rubbing contact.

Although the teachings of our invention have herein been discussed with reference to specific theories and embodiments, it is to be understood that these are by way of illustration only and that others may wish to utilize our invention in different designs or applications.

We claim as our invention:

1. A device for applying ignition lines on the inner surface of surge voltage arrestors comprising a movable carriage member, glass member supporting devices on said carriage member, said carriage member movable in at least one direction, first and second movable feed slides reciprocatedly movable in directions at right angles to the at least one direction, the first feed slide having a first rotating drive member affixed thereon, the first rotating drive member equipped with a first chuck, a grinding point carried by said first chuck, a second rotating drive member carried by said second feed slide, said second rotating drive member equipped with a second chuck, a graphite pencil, carried by said second chuck, said first and second feed slides arranged on opposite sides of the carriage, and said chucks angled with respect to the glass member supporting devices to apply the point and pencil to the inner diameter surface of glass tubes carried by the glass member supporting devices.

2. The device of claim 1 wherein the point and the pencil are flexibly carried by the first and second chucks.

* * * * *